SR
XR 4,367,398

United States Patent [19]

Strube et al.

[11] 4,367,398

[45] Jan. 4, 1983

[54] CONTACT ELEMENT AND PROCESS FOR THE MANUFACTURE THEREOF

[75] Inventors: Harald Strube, Mainz; Karl-Edüard Helf, Wiesbaden, both of Fed. Rep. of Germany

[73] Assignee: Hoechst Aktiengesellschaft, Fed. Rep. of Germany

[21] Appl. No.: 15,262

[22] Filed: Feb. 26, 1979

Related U.S. Application Data

[63] Continuation of Ser. No. 604,049, Aug. 12, 1975, abandoned.

[30] Foreign Application Priority Data

Aug. 14, 1974 [DE] Fed. Rep. of Germany ..... 2438984

[51] Int. Cl.[3] ..... H05B 3/08

[52] U.S. Cl. ..... 219/541; 219/543; 427/122; 428/214; 428/408; 338/309

[58] Field of Search ..... 219/522, 528, 541, 543; 428/77, 423, 343, 408, 214; 427/122; 156/55, 276; 338/308

[56] References Cited

U.S. PATENT DOCUMENTS

| | | | |
|---|---|---|---|
| 2,802,566 | 8/1957 | Smith-Johannsen | 428/323 |
| 2,930,015 | 3/1960 | Blumer | 427/122 X |
| 3,179,544 | 4/1965 | Smith-Johannsen | 428/323 X |
| 3,359,525 | 12/1967 | Hubbuch | 338/308 |
| 3,387,248 | 6/1968 | Rees | 219/543 X |
| 3,707,521 | 12/1972 | DeSantis | 428/423 X |
| 3,865,626 | 2/1975 | Diener et al. | 428/408 |
| 3,878,362 | 4/1975 | Stinger | 219/528 |
| 3,898,427 | 8/1975 | Levin | 219/522 |
| 3,900,654 | 8/1975 | Stinger | 428/214 |

*Primary Examiner*—Volodymyr Y. Mayewsky
*Attorney, Agent, or Firm*—James E. Bryan

[57] ABSTRACT

This invention relates to a contact element comprising a flat body of electrically insulating plastic material, a firmly adhering layer of electrically conductive, non-metallic particles on at least one surface of said plastic material, a dielectric adhesive on at least a portion of the surface of said layer of electrically conductive, non-metallic particles, and metal strips secured to said adhesive.

This invention also relates to a process for the manufacture of the contact element.

4 Claims, 3 Drawing Figures

CONTACT ELEMENT AND PROCESS FOR THE MANUFACTURE THEREOF

This is a continuation, of application Ser. No. 604,049, filed Aug. 12, 1975 now abandoned.

This invention relates to a contact element for an electrically conductive flat body and to a process for the manufacture of the contact element. Further, the invention relates to a contact element for use with flat electric heating conductors. The present invention is based on the subject matter of U.S. Pat. No. 3,865,626.

Flat electric heating conductors differ from heaters containing conducting wires in that the electric current flows in a normally rectangular, substantially two-dimensional flat conductor and that the heat required for heating purposes is uniformly generated over the entire surface of the flat conductor. Conducting wires and metallic tape conductors normally must be arranged in a meandering form to heat a flat surface, and the individual sections of the conductive element are insulated from each other, thus producing "cold" zones at the insulating layers.

Heaters containing conducting wires may be connected with a current source by the two ends of the conductor.

In the case of flat heating conductors, however, the connection with the current supply must be made by special contact elements, i.e. electrically conductive tapes or the like having a very low electrical resistance, also referred to as "cold conductors", which are attached in a suitable manner to opposite edges of the conductive surfaces and connect them with the power supply.

It is a prerequisite for the satisfactory functioning of the flat heating conductors, i.e. for an absolutely uniform flow of current between the cold conductors, that an uninterrupted electrical contact exists between the cold conductors and the electrically conductive surface and that the contact resistance be as low and constant as possible; this contact must be provided by the contact elements.

Hitherto, this problem has been solved in different ways; thus, flat heating conductors are known in which metal tapes serving as cold conductors are either sewn onto the electrically conductive surface of the heating conductor, or cemented to it by means of an electrically conductive adhesive, or simply pressed onto it, for example by surrounding the edges of the flat heating conductor with the metal tape. Alternatively, lacquers, pastes or similar masses capable of conducting electric current have been applied to the electrically conductive surface of the flat heating conductor or metal strips have been sprayed thereon.

In the case of flat heating conductors based on textile supports, it is also possible to weave cold-conducting metal threads into the fabric used as the support.

Finally, devices are known by means of which metal fabrics or ribbons or similar electroconductive metallic structures are incorporated, as cold conductors, in the electrically conductive mass of which the electroconductive surface is made; this method can be employed, however, only when the electrically conductive layers are relatively thick.

In the case of very thin flat heating conductors, for example those based on plastic films provided with an electrically conductive coating, the known contact elements are either unsuitable or their suitability is limited.

For lack of mechanical strength (insufficient tear propagation resistance of the plastic film) for example, it is impossible to sew tapelike cold conductors onto the film. On the other hand, the thermal resistance of conventional thermoplastic films is not sufficient to allow metal layers to be sputtered onto their surfaces.

It is the object of the present invention to provide an electrical contact element for electrically conductive flat bodies which is distinguished from known electrical contact elements for electrically conductive flat bodies, in particular those based on thin plastic films with electrically conductive surfaces, by the following advantages:

The contact element according to the invention has no seams, thus avoiding the risk of the plastic film being torn at the perforations under mechanical stress. The metallic component of the element is firmly connected with the support over the entire surface thereof, other than metallic elements attached by sewing. Since its entire surface is in contact with the electrically conductive surface of the support, there is no danger of the surface of the cold conductor being oxidized.

The problem with which the present invention is concerned is solved by a contact element on a flat body of electrically insulating plastic material coated with an electrically conductive carbon black layer and having metallic contacting means on two opposite sides of the carbon black layer on the flat body.

The contact element comprises:

(a) a laminar structure of plastic material having on at least one surface thereof and in immediate contact with the surface, a firmly adhering layer of electrically conductive, non-metallic particles, (b) metal strips, and (c) an intermediate layer of a dielectric material between the surfaces of the metal strips and the electrically conductive surface of the laminar structure.

Due to the adhesive forces acting on adjoining surfaces, the intermediate layer of electrically insulating material between the surface of the metal strips facing the electrically conductive flat body and the electrically conductive layer of non-metallic particles on the flat body connects the metal strips firmly with the electrically conductive flat body.

In a preferred embodiment, the metal strips are arranged parallel to each other and at a distance from each other; they are of uniform width over their entire length.

The present invention further relates to the use of the inventive contact elements for flat heating conductors based on plastic films, especially oriented polyester films, provided on at least one surface and in immediate contact with the surface, with a firmly adhering layer of electrically conductive, non-metallic particles, in particular a layer of carbon black particles.

Further, the present invention relates to a process for the manufacture of a contact element in which the electrically conductive carbon black layer on the surface of an oriented polyester film is coated—either over its entire surface or in the form of two strips extending parallel to each other along opposite edges of the support—with an adhesive capable of joining plastic films with metal strips, metal strips extending parallel to each other are then applied to opposite edges of the adhesive coating on the plastic film or to the strips of adhesive coating extending along opposite edges of the film, and, where necessary, pressure and/or heat are then caused to act on the composite.

In connection with the present specification, the term "flat body of plastic material provided on one surface with an electrically conductive layer" means a shaped body comprising a planar support, especially a support of an electrically insulating plastic film, preferably an oriented plastic film, and in particular an oriented polyester film, which has on at least one surface and in immediate contact with that surface a firmly adhering layer of electrically conductive non-metallic particles, especially carbon black particles. A "carbon black layer in immediate contact with the film surface" means a layer which adheres firmly to the film surface without the aid of additional means.

The term "intermediate layer" as used in connection with this invention means a layer which, as compared with the thickness of the metal strip and the thickness of the supporting film of the shaped body, is thin and is not self-supporting.

The term "a layer which is not self-supporting" as used herein means a layer which is much thinner than the supporting film and which cannot be separated from the surface of the metal strip or the conductive surface of the supporting film without being mechanically damaged or destroyed.

The material forming the intermediate layer is a dielectric, organic chemical capable of acting as an adhesive, which is sufficiently heat-resistant for the intended use of the electrically conductive flat body. Due to its good adhesion to the metal strip and also to the electrically conductive surface of the flat body, it firmly unites the two materials. Materials of this type, which are based on synthetic organic compounds, for example polyurethanes, are already known and are no part of the present invention.

The process for the manufacture of the contact element for electrically conductive flat bodies is as follows:

The carbon black-coated surface of a plastic film, for example of a stretched polyester film, is covered with an adhesive coating composed of a solution of a dielectric chemical substance, for example a solution of a polyurethane in tetrahydrofuran. The coating is applied in known manner, for example by a printing process or by means of a doctor knife.

The coating is applied either over the entire surface of the film and then two metal strips, for example two copper strips, are placed in such a manner on opposite edges of the flat body that the metal strips extend parallel to each other, or, two strips of coating, each of a width corresponding to the width of the metal strips to be cemented thereto, are applied to the conductive surface of the flat body on opposite edges thereof, the two strips being arranged in such a manner that they extend parallel to each other, and then each adhesive strip is covered with a metal strip in such a manner that the lateral edges are in alignment with each other. In order to produce an adhesive intermediate layer, the solvent is then removed from the coating, for example by the action of heat onto the composite material. If desired, pressure simultaneously may be applied to the surface of the metal strip.

The embodiment of the invention in which the entire electrically conductive surface of the supporting material is provided with a coating of the material forming the intermediate layer is preferred only because the manufacturing process is simpler.

The metal strip, which is also designated as a "cold conductor" is preferably a copper ribbon which may be provided with openings; a strip of perforated metal foil may be used, for example. The metal strip need not be in the form of a solid sheet, but may have the form of a metal fabric or a metal gauze.

The electrical lead-in wires are soldered to the contact elements in known manner.

The invention will be further illustrated by reference to the accompanying drawings.

Figure 1:
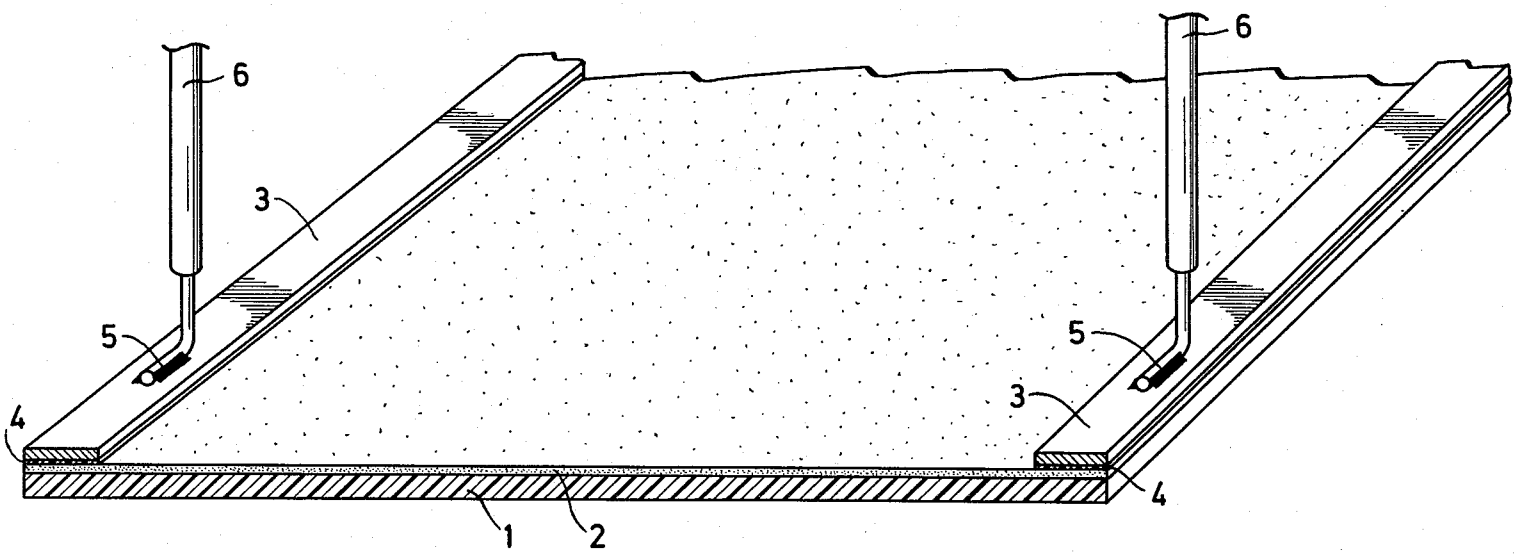
FIG. 1 is a cross-section through one embodiment of the invention.

FIG. 1 is a diagrammatic cross-section through an electrically conductive film having contact elements arranged at opposite edges of the film and extending parallel to each other. Numeral 1 designates the supporting film and 2 is the carbon black layer in immediate contact with and firmly adhering to the surface of the supporting film 1. Numeral 3 designates a metal strip, and 4 is a strip-like, electrically non-conductive intermediate layer between the metal strip and the carbon black layer 2. Numeral 5 designates a joint on the surface of the metal strip, and 6 is a lead-in wire which is attached to the metal strip by means of the soldered joint 5 and connects it with the current source.

Figure 2:
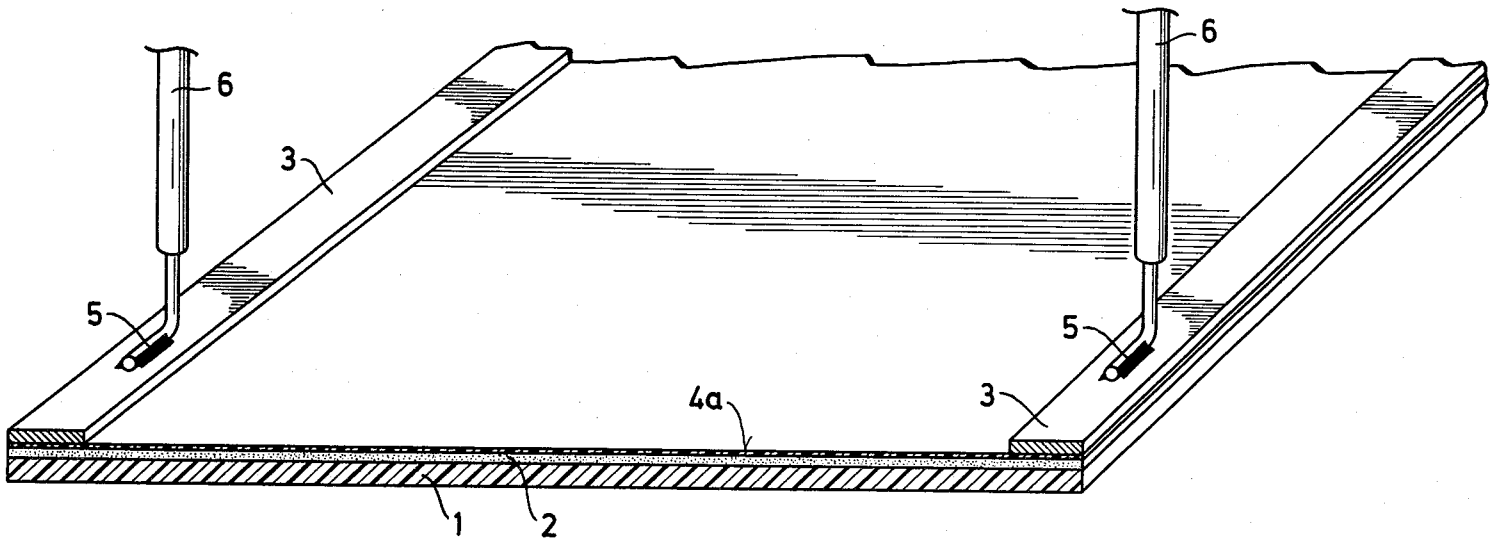
FIG. 2 is a cross-section through another embodiment of the invention.

FIG. 2 shows an electrically conductive film in which a continuous, electrically non-conductive intermediate layer **4*a* is applied to the carbon black layer 2**.

EXAMPLE

Base material: Web of oriented polyester film,

Thickness of the web: 25μ

Width of the web: 60 cm

One surface of the web has a firmly adhering carbon black layer in immediate contact with the surface thereof.

Figure 3:
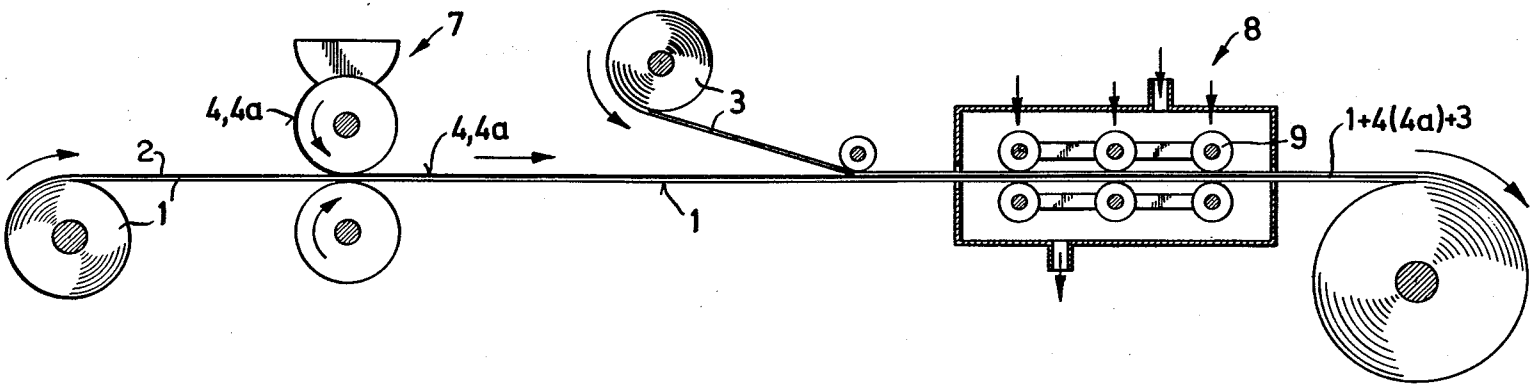
FIG. 3 is a flow sheet.

Referring to FIG. 3, the carbon black-coated surface 2 of the film 1 is coated, by means of a known doctor knife device 7, with an adhesive solution 4, **4*a* composed of a polyurethane dissolved in tetrahydrofuran. After coating with the adhesive, but before entering the drying channel 8, at least two 10 mm wide metal strips 3 are placed on the liquid layer 4, 4*a*. The edges of the metal strips 3 extend parallel to one another and to the longitudinal edges of the film web 1. The metal strips 3** are arranged at a distance of approximately 50 cm from each other.

The film web 1, 4, **4*a*, carrying the metal strips 3 is then passed through a drying channel 8 operated with hot air of a temperature sufficient to evaporate the solvent from the liquid layer. In addition, a pressing device 9** may be provided.

It will be obvious to those skilled in the art that many modifications may be made within the scope of the present invention without departing from the spirit thereof, and the invention includes all such modifications.

What is claimed is:

1. An electrical resistance tape having two contacts comprising a flat body of electrically insulating plastic material, a layer consisting exclusively of carbon black particles, said layer being firmly adhered to the surface of said plastic material without the aid of additional adhesive means, a dielectric adhesive on at least a portion of the surface of said layer of electrically conductive, non-metallic particles, and spaced metal strips secured to said adhesive, whereby electric current may be conducted in said layer for heating.

2. An electrical resistance tape according to claim 1 in which said insulating plastic material is an oriented polyester film.

3. An electrical resistance tape according to claim 1 in which said adhesive is a polyurethane.

4. An electrical resistance tape according to claim 1 in which said metal strips are secured by said adhesive to two opposite edges of said layer of carbon black particles on said flat body.

* * * * *

UNITED STATES PATENT AND TRADEMARK OFFICE

CERTIFICATE OF CORRECTION

PATENT NO. : 4,367,398

DATED : January 4, 1983

INVENTOR(S) : Harald Strube; and Karl-Eduard Helf

It is certified that error appears in the above—identified patent and that said Letters Patent is hereby corrected as shown below:

Column 5, lines 4 and 5, "electrically conductive, non-metallic" should read - - - carbon black - - -.

Signed and Sealed this

Tenth Day of May 1983

[SEAL]

*Attest:*

GERALD J. MOSSINGHOFF

*Attesting Officer*

*Commissioner of Patents and Trademarks*